US006785917B1

(12) United States Patent
Bryant

(10) Patent No.: US 6,785,917 B1
(45) Date of Patent: Sep. 7, 2004

(54) INFANT TUB WITH REMOVABLE SEAT

(76) Inventor: Tennie Bryant, 6635 S. Hermitage, Chicago, IL (US) 60636

( * ) Notice: Subject to any disclaimer, the term of this patent is extended or adjusted under 35 U.S.C. 154(b) by 0 days.

(21) Appl. No.: 10/612,488

(22) Filed: Jul. 3, 2003

(51) Int. Cl.[7] ..... A47K 3/024
(52) U.S. Cl. ..... 4/572.1; 4/659; 4/579
(58) Field of Search ..... 4/572.1, 659, 571.1, 4/573.1, 574.1, 575.1, 578.1, 579, 586

(56) References Cited

U.S. PATENT DOCUMENTS 4,996,729 A * 3/1991 Zellner ..... 4/575.1
5,020,168 A * 6/1991 Wood ..... 4/573.1
5,181,284 A * 1/1993 Raphael et al. ..... 4/572.1
5,276,926 A * 1/1994 Lopez ..... 4/572.1
5,722,100 A * 3/1998 Jozwiak ..... 4/572.1
5,926,866 A * 7/1999 Chao ..... 4/572.1
6,243,890 B1 * 6/2001 Yang ..... 4/572.1

* cited by examiner

*Primary Examiner*—Gregory L. Huson
*Assistant Examiner*—Khoa D. Huynh

(57) ABSTRACT

An infant tub with removable seat for allowing the user to not have to hold onto the infant while bathing the infant. The infant tub with removable seat includes a bathtub member having side, foot, back, and bottom walls, and also having an open top, and also having an elongate support member being disposed at the open top and interconnecting the side walls for supporting play things thereupon; and also includes a cushioned seat member being removably fastened against the back wall in the bathtub member; and further includes a securement member for fastening about a child being seated in the cushioned seat member in the bathtub member.

5 Claims, 3 Drawing Sheets

INFANT TUB WITH REMOVABLE SEAT

BACKGROUND OF THE INVENTION

1. Field of the Invention

The present invention relates to infant bathtubs with removable seats and more particularly pertains to a new infant tub with removable seat for allowing the user to not have to hold onto the infant while bathing the infant.

2. Description of the Prior Art

The use of infant bathtubs with removable seats is known in the prior art. More specifically, infant bathtubs with removable seats heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 6,108,826; U.S. Pat. No. 5,588,159; U.S. Pat. No. 6,253,392; U.S. Pat. No. 5,361,430; U.S. Pat. No. 5,321,859; U.S. Pat. No. 4,881,281; U.S. Pat. No. Des. 360,933; and U.S. Pat. No. Des. 419,785.

While these devices fulfill their respective, particular objectives and requirements, the aforementioned patents do not disclose a new infant tub with removable seat. The prior art includes tubs used for bathing children.

SUMMARY OF THE INVENTION

The general purpose of the present invention, which will be described subsequently in greater detail, is to provide a new infant tub with removable seat which has many of the advantages of the infant bathtubs with removable seats mentioned heretofore and many novel features that result in a new infant tub with removable seat which is not anticipated, rendered obvious, suggested, or even implied by any of the prior art infant bathtubs with removable seats, either alone or in any combination thereof. The present invention includes a bathtub member having side, foot, back, and bottom walls, and also having an open top, and also having an elongate support member being disposed at the open top and interconnecting the side walls for supporting play things thereupon; and also includes a cushioned seat member being removably fastened against the back wall in the bathtub member; and further includes a securement member for fastening about a child being seated in the cushioned seat member in the bathtub member. None of the prior art includes the combination of the elements of the present invention.

There has thus been outlined, rather broadly, the more important features of the infant tub with removable seat in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new infant tub with removable seat which has many of the advantages of the infant bathtubs with removable seats mentioned heretofore and many novel features that result in a new infant tub with removable seat which is not anticipated, rendered obvious, suggested, or even implied by any of the prior art infant bathtubs with removable seats, either alone or in any combination thereof.

Still another object of the present invention is to provide a new infant tub with removable seat for allowing the user to not have to hold onto the infant while bathing the infant.

Still yet another object of the present invention is to provide a new infant tub with removable seat that is easy and convenient to set up and use.

Even still another object of the present invention is to provide a new infant tub with removable seat that allows the user to be hands free with the infant being securely and comfortably seated in the bathtub member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
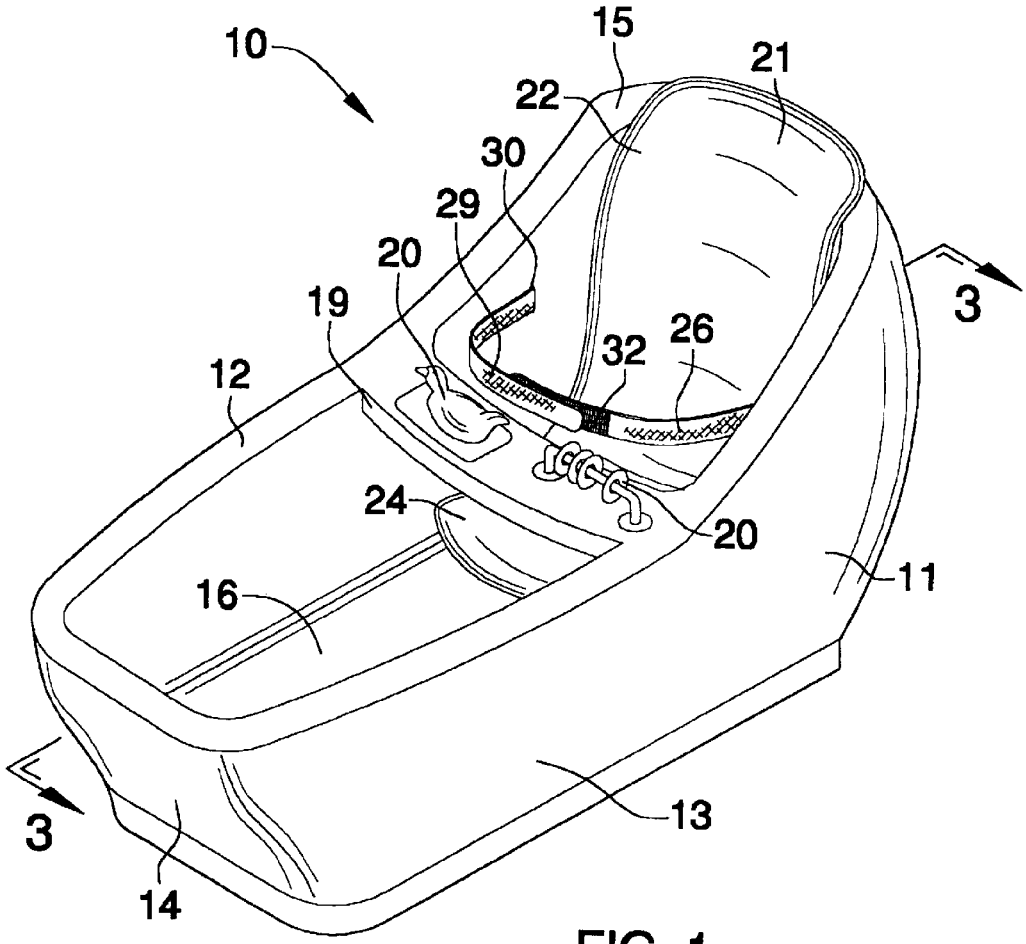
FIG. 1 is a perspective view of a new infant tub with removable seat according to the present invention.
Figure 2:
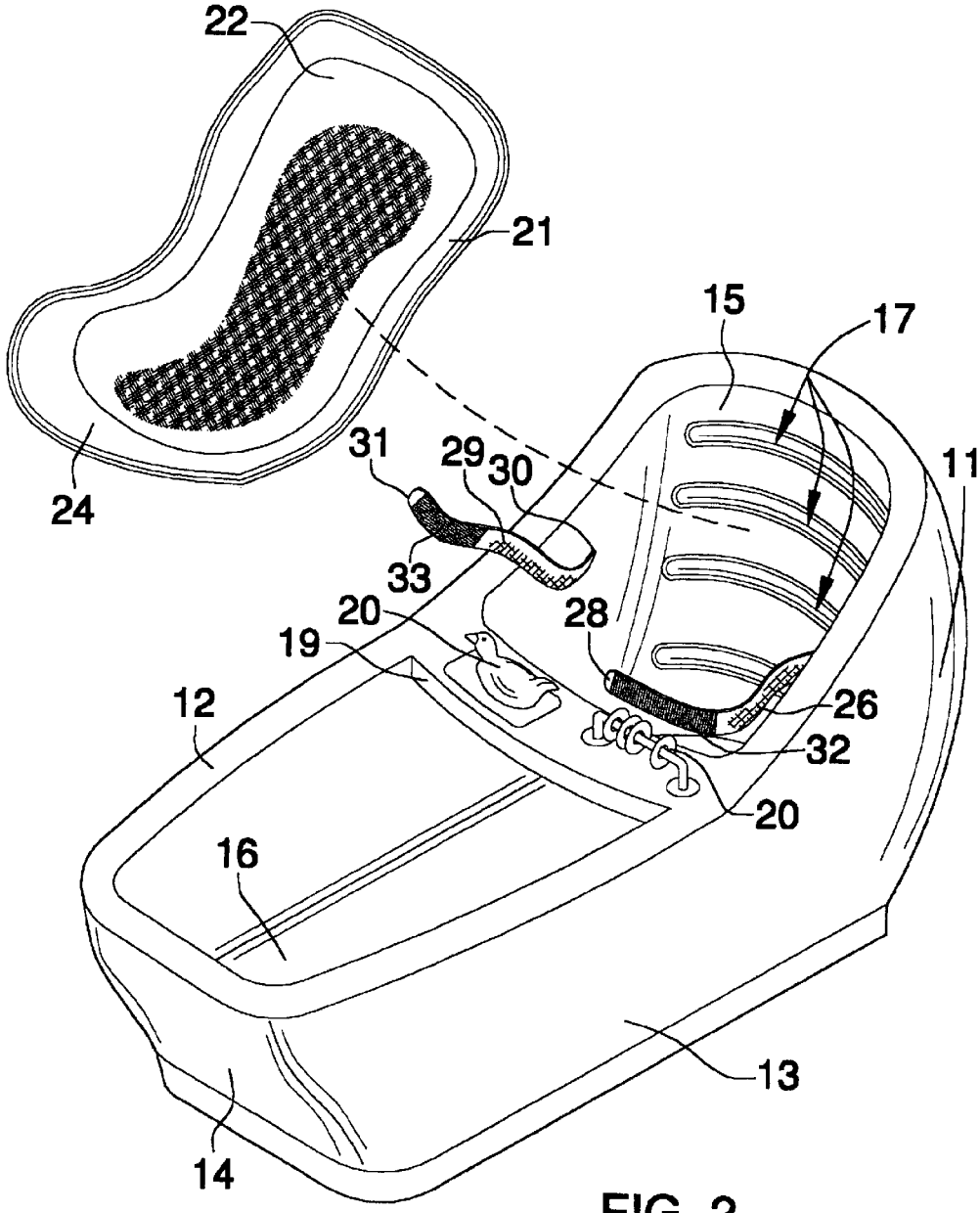
FIG. 2 is an exploded perspective view of the present invention.
Figure 3:
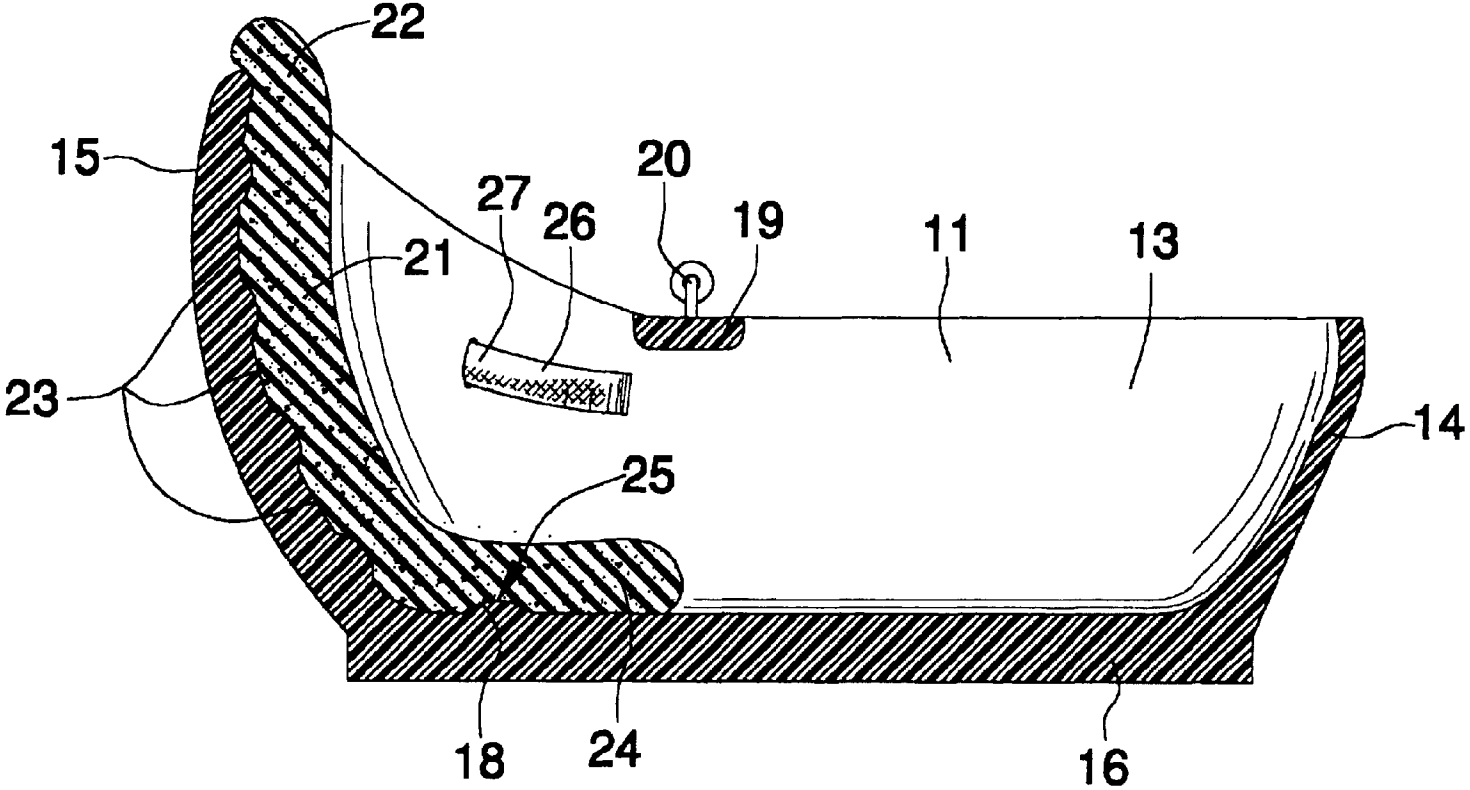
FIG. 3 is a longitudinal cross-sectional view of the present invention.

With reference now to the drawings, and in particular to FIGS. 1 through 3 thereof, a new infant tub with removable seat embodying the principles and concepts of the present invention and generally designated by the reference numeral 10 will be described.

As best illustrated in FIGS. 1 through 3, the infant tub with removable seat 10 generally comprises a bathtub member 11 having side, foot, back, and bottom walls 12–16, and also having an open top, and also having an elongate support member 19 being conventionally disposed at the open top and integrally interconnecting the side walls 12,13 for supporting playthings 20 thereupon. The back wall 15 of the bathtub member 11 has a greater height than that of the foot wall 14 of the bathtub member 11, and also has a plurality of laterally-extending grooves 17 being spacedly disposed in an inner side thereof, and is longitudinally curved inwardly from the open top of the bathtub member 11 to the bottom wall 16 of the bathtub member 11. The laterally-extending grooves 17 are spaced from the open top of the bathtub member 11 to the bottom wall 16 of the bathtub member 11. The bathtub member 11 further includes a laterally-extending ridge 18 being integrally disposed upon the bottom wall 16 near the back wall 15 of the bathtub member 11.

A cushioned seat member 21 is removably engaged against the back and bottom walls 15,16 in the bathtub member 11. The cushioned seat member 21 includes a backrest portion 22 having a backside and a front side, and also includes a seat portion 24 having a top side and a bottom side with the seat portion 24 being angled relative to the backrest portion 22. The backrest portion 22 has a plurality of laterally-extending ribs 23 being spacedly and integrally disposed upon the backside thereof. The laterally-extending ribs 23 are spaced from a top of the backrest portion 22 to a bottom of the backrest portion 22. The laterally-extending ribs 23 are removably engaged in the laterally-extending grooves 17 of the bathtub member 11. The seat portion 24 has a laterally-extending slot 25 being disposed in the bottom side thereof. The laterally-extending ridge 18 of the bathtub member 11 is removably engaged in the laterally-extending slot 25 to prevent the cushioned seat member 21 from sliding in the bathtub member 11.

A securement member for fastening about a child being seated in the cushioned seat member 21 in the bathtub member 11 includes a pair of straps 26,29 having first ends 27,30 being conventionally attached to inner sides of the side walls 12,13 near the back wall 15 of the bathtub member 11, and also includes strips of hook and loop fasteners 32,33 being conventionally attached along second end portions 28,31 of the pair of straps 26,29 and being fastenable to one another with the pairs of straps 26,29 being strapped about the child being seated upon the cushioned seat member 21.

In use, the user engages the cushioned seat member 21 to the back and bottom walls 15,16 in the bathtub member 11 and places the child in the bathtub member 11 upon the cushioned seat member 21 and secures the child by fastening the pairs of straps 26,29 about the child so that the child does not slip down into the bathtub member 11 and allows the user to be hands free to effectively bathe the child.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the infant tub with removable seat. Further, since numerous modifications and changes will readily occur to those skilled in the art, it is not desired to limit the invention to the exact construction and operation shown and described, and accordingly, all suitable modifications and equivalents may be resorted-to, falling within the scope of the invention.

I claim:

1. An infant tub with removable seat comprising:

a bathtub member having side, foot, back, and bottom walls, and also having an open top, and also having an elongate support member being disposed at said open top and interconnecting said side walls for supporting play things thereupon;

a cushioned seat member being removably engaged to said back and bottom walls in said bathtub member; and a securement member for fastening about a child being seated in said cushioned seat member in said bathtub member wherein said back wall of said bathtub member has a greater height than that of said foot wall of said bathtub member, and also has a plurality of laterally-extending grooves being spacedly disposed in an inner side thereof, and is longitudinally curved inwardly from said open top of said bathtub member to said bottom wall of said bathtub member, said laterally-extending grooves being spaced from said open top of said bathtub member to said bottom wall of said bathtub member, and wherein said bathtub member further includes a laterally-extending ridge being disposed upon said bottom wall near said back wall of said bathtub member.

2. The infant tub with removable seat as described in claim 1, wherein said cushioned seat member includes a backrest portion having a backside and a front side, and also includes a seat portion having a top side and a bottom side, said seat portion being angled relative to said backrest portion.

3. The infant tub with removable seat as described in claim 2, wherein said backrest portion has a plurality of laterally-extending ribs being spacedly disposed upon said backside thereof, said laterally-extending ribs being spaced from a top of said backrest portion to a bottom of said backrest portion, said laterally-extending ribs being removably engaged in said laterally-extending grooves of said bathtub member.

4. The infant tub with removable seat as described in claim 3, wherein said seat portion has a laterally-extending slot being disposed in said bottom side thereof, said laterally-extending ridge of said bathtub member being removably engaged in said laterally-extending slot to prevent said cushioned seat member from sliding in said bathtub member.

5. The infant tub with removable seat as described in claim 4, wherein said securement member includes a pair of straps having first ends being attached to inner sides of said side walls near said back wall of said bathtub member, and also includes strips of hook and loop fasteners being attached along second end portions of said pair of straps and being fastenable to one another with said pairs of straps being strapped about the child being seated upon said cushioned seat member.

* * * * *